US008331597B2

(12) United States Patent
Fickweiler et al.

(10) Patent No.: US 8,331,597 B2
(45) Date of Patent: Dec. 11, 2012

(54) CONNECTING ELEMENT FOR A CARRYING HOOK OF A HEARING DEVICE

(75) Inventors: Werner Fickweiler, Bubenreuth (DE); Björn Freels, Hersbruck (DE); Holger Kral, Fürth (DE); Joseph Sauer, Strullendorf (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 961 days.

(21) Appl. No.: 12/150,582

(22) Filed: Apr. 29, 2008

(65) Prior Publication Data

US 2008/0273732 A1 Nov. 6, 2008

(30) Foreign Application Priority Data

Apr. 30, 2007 (DE) ..... 10 2007 020 340

(51) Int. Cl.
*H04R 25/00* (2006.01)

(52) U.S. Cl. ..... 381/330; 381/151; 381/322; 381/324; 381/328; 381/381; 381/312

(58) Field of Classification Search ..... 381/151, 381/312, 322, 324, 328, 381
See application file for complete search history.

(56) References Cited

U.S. PATENT DOCUMENTS

| | | | | |
|---|---|---|---|---|
| 4,747,582 | A * | 5/1988 | Bergstrom et al. | 266/226 |
| 5,606,621 | A * | 2/1997 | Reiter et al. | 381/328 |
| 5,761,319 | A * | 6/1998 | Dar et al. | 381/330 |
| 7,221,770 | B2 | 5/2007 | Fickweiler et al. | |
| 7,396,265 | B2 | 7/2008 | Darley et al. | |
| 2005/0020127 | A1 | 1/2005 | Fickweiler et al. | |
| 2005/0266380 | A1 | 12/2005 | Soler et al. | |
| 2006/0141861 | A1 | 6/2006 | Darley et al. | |
| 2007/0242845 | A1 * | 10/2007 | Westermann | 381/330 |

FOREIGN PATENT DOCUMENTS

| | | | |
|---|---|---|---|
| CH | 689 685 | A5 | 8/1999 |
| DE | 3720591 | C2 | 1/1988 |
| DE | 4327634 | C1 | 6/1994 |
| DE | 19935276 | A1 | 2/2000 |
| DE | 103 33 293 | A1 | 3/2005 |
| EP | 1570804 | A1 | 9/2005 |
| WO | WO 2004/030159 | A1 | 4/2004 |
| WO | 2006125434 | A1 | 11/2006 |

OTHER PUBLICATIONS

Gross, "What Designers Should Know about Metal Injection Technology", Medical Design, (Online); 2006, pp. 1, 1-2, retrieved from Internet Jul. 31, 2008, http://medicaldesign.com/moldingidesigners_know_metal/; XP002490908.

* cited by examiner

*Primary Examiner* — Andy Huynh

(57) ABSTRACT

In order to connect a hearing device to a carrying hook, a connecting element is used, which has to satisfy high demands with regards to its precision and stability. To ensure this, the connecting element is designed as a powder injection molded part, in particular as a ceramic injection molded part or metal part, which is manufactured in a ceramic injection molding process or a metal injection molding process.

9 Claims, 2 Drawing Sheets

CONNECTING ELEMENT FOR A CARRYING HOOK OF A HEARING DEVICE

CROSS REFERENCE TO RELATED APPLICATIONS

This application claims priority of German application No. 10 2007 020 340.5 filed Apr. 30, 2007, which is incorporated by reference herein in its entirety.

FIELD OF THE INVENTION

The invention relates to a connecting element for connecting a carrying hook to a hearing device which has a housing, as well as to a method for producing a connecting element for connecting a carrying hook to a hearing device which has a housing.

BACKGROUND OF THE NVENTION

Hearing devices, which can be worn behind the ear, are usually clamped to a carrying hook behind the ear of a hearing device holder. Aside from its carrying function, the carrying hook is also able to fulfill other tasks. In particular, the carrying hook can have a sound channel, so that it serves as a sound tube connecting piece. Thus embodied, the carrying hook, in this function, is able to forward the sound, which is in a receiver arranged in the hearing device, via an adapted ear piece into the auditory canal of the hearing device wearer. A hearing device of this type to be worn behind the ear is known for instance from CH 689 685 A5. In this invention, the hearing device has a housing, which consists of two halves. Furthermore, a carrying frame for accommodating electrical or electronic components can be provided within the housing.

A connection needs to be established between the hearing device and the carrying hook in order for the hearing device to be used. As is known from CH 689 685 A5, this connection can be achieved by a latching plug-in coupling or a screw fitting. These connecting elements are elaborately-produced turned or milled parts, which, following their manufacture, mostly still have to be processed in additional work steps. In particular, it is necessary to bend the carrying hooks into shape. Solutions are also known in which the connecting pieces are manufactured from plastic. Solutions in which a metal connecting piece and a plastic carrying frame for the components are integrated into an injection molded part are already known.

According to current requirements, it is necessary to design the connection between the sound tube connecting piece, the so-called carrying hook and the hearing device such that they are on the one hand mechanically stable and on the other hand acoustically sealed.

SUMMARY OF THE INVENTION

The object of the present invention is to propose a connecting element for a carrying hook of a hearing device as well as a method for producing a connecting element that can be manufactured in a cost-effective manner despite the high demands placed on its mechanical rigidity, precision and stability.

This object is achieved in accordance with the invention by a connecting element for connecting a carrying hook to a hearing device which has a housing, with the connecting element for the carrying hook and the hearing device being embodied as a powder injection molded part. For instance, the connecting element can be embodied as a ceramic injection molded part. In an alternative solution, the connecting element can be embodied as a metal part produced in a metal injection molding process.

With regard to the method, the object is achieved by a method for producing a connecting element for connecting a carrying hook to a hearing device which has a housing, with the connecting element being produced in a powder injection molding method. This method ensures that an efficient manufacturing method can also be used for large quantities and for technically demanding forms of the connecting element to be produced. A method for ceramic powder injection molding or a metal injection molding (MIM process) can be used here as a powder injection molding method. Both methods basically have the same method steps, which essentially include material preparation, molding, debinding and sintering.

During material preparation, the ceramic or metal powder is coated here with a suitable binding system. All sinter-capable powders with suitable particle sizes can essentially be used as metal or ceramic powder. By way of example, oxide, nitride or silicate ceramics, metals or metal alloys as well as precious metals can be used. Suitable organic compounds can be used as binders. By way of example, a suitable polyolefin wax mixture can be used. In addition, partially soluble systems can also be used, in which a part of the binder can be removed in organic solvents. Binding systems, which result from the catalytic decomposition of polyoxymethylene, can likewise be used.

During molding, the bound powder is injected into the prepared mold and the thus produced connecting element is extracted. The connecting element is then subjected to a debinding process, thereby achieving a very porous molded part. The required rigidity can be achieved in subsequent sintering and/or combustion processes by compressing the material.

In one embodiment of the invention, the connecting element can be manufactured as a ceramic injection molded part. This proves particularly favorable since the ceramic injection molding is suited to producing mass-produced articles without a significant restriction in the design of the connecting element to be produced needing to be accepted. This thus enables a very large degree of geometric freedom to be drawn on, which can only be realized by additional work steps in the conventional method. In particular, curved channels, roundings and narrow wall thicknesses can be realized in a simple manner in the ceramic injection molding method. For the ceramic injection molding method, different ceramic powders can be used as raw material, zirconium dioxide ($ZrO_2$) can be used in particular. The used ceramic powder is plasticized with organic additives and is injection molded into the desired shape in a hard metal mold using high pressure. The required form of the connecting element is thus produced in each instance.

In a further embodiment of the invention, the connecting element can be produced as a metal part, with the metal part being manufactured in the so-called metal injection molding process (MIM). This technology for producing metal parts with a defined form ensures a precision required for the connecting element and furthermore very good properties in respect of stability and surface quality. A metal or a metal alloy powder is used as a raw substance. The connecting element is then produced by using the already described process steps, material preparation, molding, debinding and sintering.

The method according to the invention thus achieves in significantly simplifying the production process of the connecting element. In particular, turning or milling processes as well as complicated inlay processes for metal plastic composite materials are omitted. A significant reduction in the manufacturing costs and thus the costs for the connecting elements can thus be achieved. The connecting elements according to the invention are mechanically very stable and are acoustically sealed. They can be realized both as a screw fitting and as plug-in connection or as a combination of the two.

In a further embodiment of the invention, both the connecting element as well as a carrying frame provided therefor for carrying components can be produced from the same material. This is particularly advantageous in process technology terms if the connecting element and the carrying frame are embodied in one piece to carry the components. Both elements can then be produced in a method as a powder injection molded part. This is also advantageous in that the otherwise conventional locking devices can be dispensed with, as a result of which space and components can be saved.

With a housing composed of several parts, the carrying frame attached to the connecting element can then be easily covered externally.

To this end, the production process according to the invention can be used in a simple fashion to provide a holding element on the connecting element for holding a connecting tube to a receiver. An additional adhesion process can thus be omitted. The holding element can be realized for instance in the form of retaining ridges or teeth.

BRIEF DESCRIPTION OF THE DRAWINGS

Further advantages and advantageous embodiments of the invention form the subject matter of the figures below as well as their associated descriptions; in which.

DETAILED DESCRIPTION OF THE INVENTION

Figure 1:
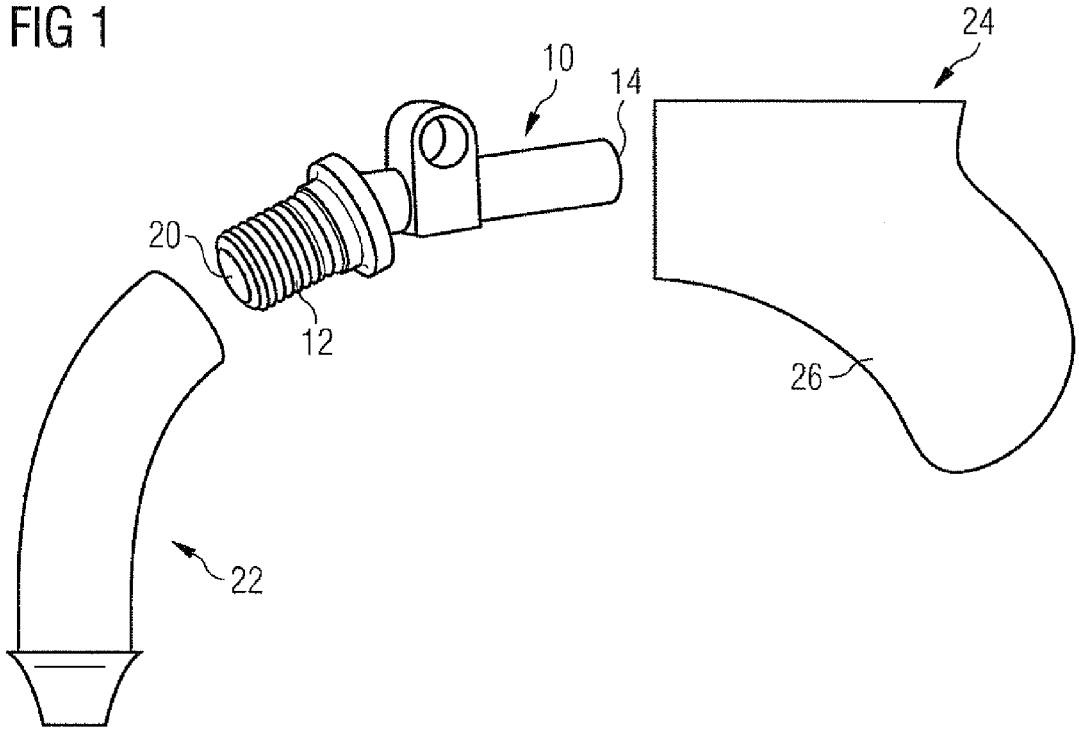
FIG. 1: shows a detailed example of an inventive connecting element

FIG. 1 shows an exemplary three-dimensional illustration of a connecting element 10 for connecting a schematically illustrated carrying hook 22 to a similarly schematically illustrated hearing device 24. The connecting element 10 has a first connecting end 20, with which it can be connected to the carrying hook 22. The connection can be configured as a screw fitting or plug-in connection or as a combination of the two. In order to realize a plug-in connection, holding elements, in particular retaining ridges 12, can be provided, so that an adhesion process can be omitted. It is similarly possible to attach teeth to the connecting element 10, which also guarantee a reliable and high-quality assembly without requiring a highly accurate fit. The first connecting end 20 can also have an external thread, which is configured such that it cuts an internal thread into the carrying hook 22 to be attached thereto.

The connecting element 10 has a second connecting end 14, with which it can be connected to a hearing device 24. The hearing device 24 is only illustrated schematically and has a housing 26, which can also be composed of several parts, in particular of two shells. The second connecting end 14 is fed into the hearing device 24 and the hearing device 24 is fastened to the connecting element 10.

Figure 3:
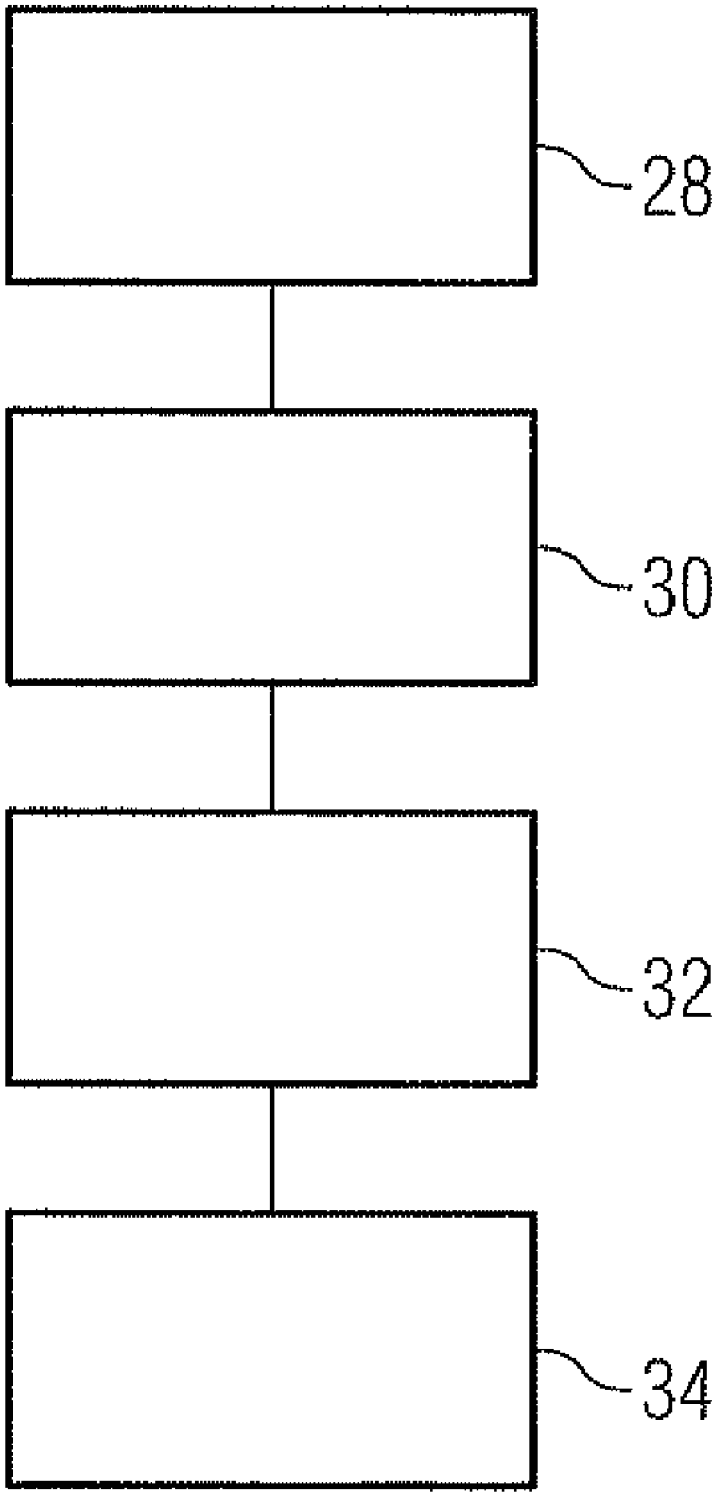
FIG. 3: shows a detailed schematic illustration of the procedure of the method according to the invention

In accordance with the invention, the connecting element 10 is produced as a powder injection molded part, in other words in a metal injection molding process (MIM process) or as a ceramic injection molded part, with this process being described in more detail in conjunction with FIG. 3.

Figure 2:
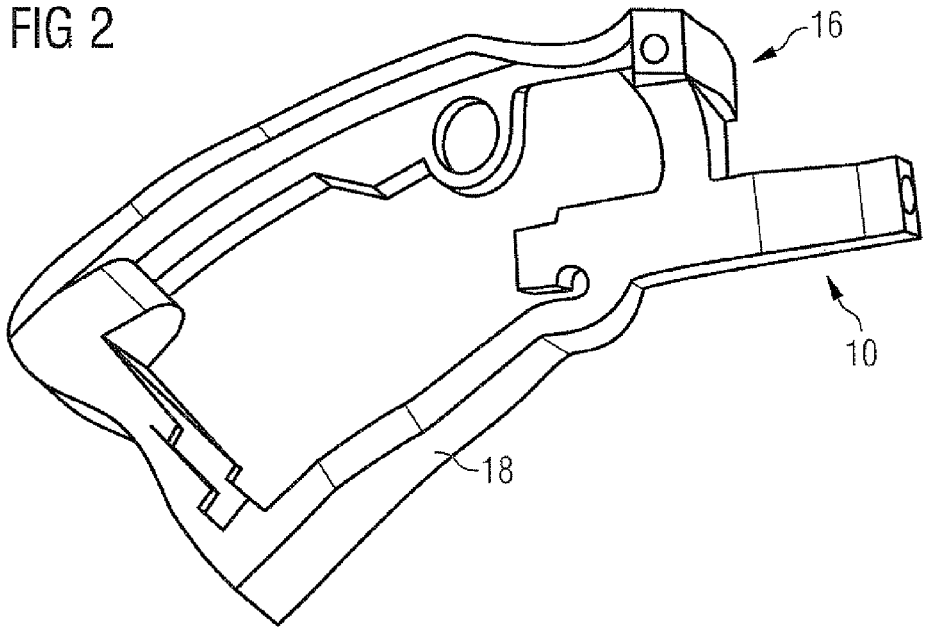
FIG. 2: shows a detailed example of an inventive connecting element with an integrated carrying frame

As FIG. 2 shows, the connecting element 10, defined by the special production method, can also be produced as an integrated element 16. In this way, the connecting element 10 together with a carrying frame 18 forms the integrated element 16. The carrying frame 18 is used here to mount the components located in the hearing device 24. In accordance with the invention, the connecting piece 10, together with the carrying frame, is produced from the same material and in one piece in the powder injection molding process, in other words the MIM process or as a ceramic injection molded part. Instead of providing the carrying frame 18 in the integrated element 16, it is also possible to provide a housing part of the hearing device 24.

FIG. 3 shows a schematic illustration of the procedure of the method according to the invention, which essentially proceeds in four method steps. The first method step consists in material preparation 28. Here a ceramic or metal powder is homogenized for the subsequent injection molding process, with sinterable powder particles of a suitable grit size being coated with a binding system. Oxide, silicate and nitride ceramics, carbides or metal alloys are considered for instance as raw powders. As binders, polyolefin wax mixtures or partially soluble systems can be used for instance, in which a part of the binder can be removed in organic solvents. Polyalcohols or polyvinylalcohols can also be used, which have the additional advantage of being water soluble.

The molding 30 takes place in the next process step. The homogenized material is injected into a mold, with the mold being tempered, preferably liquid tempered. The thus injection-molded parts already essentially achieve the shape of the desired connecting element 10.

The connecting element 10 is then debound in the debinding step 32. This can be carried out in different ways, depending on the binding system. To this end, typical processes are for instance thermal, catalytic or so-called solvent debinding.

The very porous connecting elements 10 following implementation of this step are then hardened. This so-called sintering 34 is a thermal compression process, with which the desired properties of the connecting element can be obtained. Subsequently, the connecting element blank can, as far as necessary, be subjected to barrel finishing process. The stainless steel parts are provided in a container lined with rubber together with grinding bodies, which mostly consist of ceramics, water and a wash solution. Rotating or vibrating the container produces abraded material on the surface and on the edges of the material parts. The barrel finishing produces a very smooth and matt-finished surface, depending on the duration of the grinding process, thereby rendering the products visually pleasing.

During the implementation of the ceramic injection molding process, the ceramic powder, for instance zirconium dioxide ($ZrO_2$), is plasticized with organic additives and injected into a hard metal mold. Over a longer period of time, the connecting element 10 thus produced is thermally debound, manually cleaned and sintered. Zirconium dioxide can be used to produce a thin-walled connecting element particularly due to its low friction coefficients.

The use of the MIM process or the ceramic injection molded part significantly simplifies the production of a connecting element 10. Turning and milling processes as well as complicated inlay work for the otherwise conventional metal plastic compounds can thus be omitted. In addition, it is possible to dispense with the partially inaccurate bending process. This increases the quality of the products, since an improvement in the accuracy can be achieved. The connecting element 10 thus produced retains its good mechanical properties by virtue of the material. The high demands on the loading capacity of the connection can thus be retained. Furthermore, it is possible to attach an external thread to the connecting element 10, said external thread cutting an internal thread into the carrying hook, this not being possible with the hitherto used plastic connecting elements. The production of an integrated element 16 is also significantly advantageous. Because the stability is increased, a simple separability of the hearing device 24 from the connecting element 10 is simultaneously retained by means of a so-called push-on-screw-off connection. Furthermore, it is possible to dispense with an otherwise necessary locking device, as a result of which additional space is in turn obtained.

The invention claimed is:

1. A hearing device, comprising:

a carrying hook;

a carrying frame; and a connecting element, wherein the connecting element comprises a same material as the carrying frame and wherein the connecting element and the carrying frame are formed as a single component, wherein the connecting element comprises a sound channel spanning from an interior region of the carrying frame, through the connecting element, to a region exterior to the carrying frame, and wherein the sound channel spans from the interior region of the carrying frame to a sound tube disposed at least partially in the carrying hook.

2. The hearing device as claimed in claim 1, wherein the single component is a ceramic injection molded component.

3. The hearing device as claimed in claim 2, wherein the single component comprises zirconium dioxide.

4. The hearing device as claimed in claim 1, wherein the single component is a metal injection molded component.

5. The hearing device as claimed in claim 1, further comprising a housing comprising a same material as the connecting element.

6. The hearing device as claimed in claim 1, wherein the connecting element comprises a holding element for holding a connecting tube on the connecting element.

7. The hearing device as claimed in claim 6, wherein the holding element is selected from the group consisting of: a retaining ridge, teeth, and a self-tapping thread.

8. A hearing device, comprising:

a housing;

a carrying hook; and a connecting element, wherein the connecting element comprises a same material as the housing and wherein the connecting element and at least a part of the housing are formed as a one-piece component, wherein the connecting element comprises a sound channel spanning from an interior region of the carrying frame, through the connecting element, to a region exterior to the carrying frame, and wherein the sound channel spans from the interior region of the carrying frame to a sound tube disposed at least partially in the carrying hook.

9. The hearing device as claimed in claim 8, further comprising a carrying frame comprising a same material as the connecting element.

* * * * *